US005085355A

United States Patent [19]

Yoshimura et al.

[11] Patent Number: 5,085,355

[45] Date of Patent: * Feb. 4, 1992

[54] LIQUID STORAGE CONTAINER PREVENTING LIQUID BACKFLOW

[75] Inventors: Shigeru Yoshimura, Yokohama; Tetsuo Suzuki, Kawasaki; Makoto Takemura, Tokyo, all of Japan

[73] Assignee: Canon Kabushiki Kaisha, Tokyo, Japan

[ * ] Notice: The portion of the term of this patent subsequent to Jul. 18, 2006 has been disclaimed.

[21] Appl. No.: 359,410

[22] Filed: May 31, 1989

Related U.S. Application Data

[62] Division of Ser. No. 945,769, Dec. 23, 1986, Pat. No. 4,848,602.

[30] Foreign Application Priority Data

Dec. 28, 1985 [JP] Japan ..... 60-297558
Dec. 28, 1985 [JP] Japan ..... 60-297559

[51] Int. Cl.[5] ..... B67D 3/00

[52] U.S. Cl. ..... 222/564; 141/286; 220/86 AT; 222/465.1

[58] Field of Search ..... 222/564, 129, 465.1; 220/86 AT, 1 C, 86 R, 90.4; 141/97, 286, 339, 311 A

[56] References Cited

U.S. PATENT DOCUMENTS

| | | | |
|---|---|---|---|
| 1,328,184 | 1/1920 | Moore | 222/564 X |
| 1,928,569 | 9/1933 | Moreland | 220/86 AT |
| 1,939,423 | 12/1933 | Wahl | 220/86 AT |
| 2,038,676 | 4/1936 | Readeker | 220/86 AT |
| 2,050,793 | 8/1936 | Hille | 220/86 AT |
| 2,511,291 | 6/1950 | Mueller | 222/129 X |
| 3,257,101 | 6/1966 | Ranson | 141/339 X |
| 4,298,130 | 11/1981 | Ifrach | 220/86 AT X |
| 4,658,975 | 4/1987 | Cone | 222/465.1 X |
| 4,804,119 | 2/1989 | Goodall | 222/465.1 X |
| 4,848,602 | 7/1989 | Yoshimura et al. | 222/465.1 X |

*Primary Examiner*—Kevin P. Shaver
*Attorney, Agent, or Firm*—Fitzpatrick, Cella, Harper & Scinto

[57] ABSTRACT

A liquid storage container includes a supply port for supplying the liquid, and liquid path forming structure provided within the liquid container for preventing direct backflow of liquid in the container to the supply port. The liquid path forming structure is detachable from the liquid container and includes a projecting member having a sloped surface provided below the supply port. The liquid path forming structure also includes structure for defining a first flow path for passing liquid therethrough. This structure includes a lowermost section of the sloped surface and defines a first port. The liquid path forming structure also includes structure for defining a second flow path for passing liquid into the container. This structure includes a portion of the projecting member and defines a second port. The second port is in communication with a lowermost portion of the second flow path, and the first port is in communication with an intermediate portion of the second flow path.

10 Claims, 5 Drawing Sheets

LIQUID STORAGE CONTAINER PREVENTING LIQUID BACKFLOW

This application is a division of Ser. No. 945,769, filed Dec. 23, 1986, now U.S. Pat. No. 4,848,602.

BACKGROUND OF THE INVENTION

1. Field of the Invention

This invention relates to a liquid storage container such as a water bottle, a canteen, a flask, etc. for carrying water or various beverages during hikings, trips, etc. or a container for storing a liquid to be provided in a machine or an apparatus such as an ink reserve tank or a waste ink tank in an ink jet recording apparatus, and also to an apparatus provided with the liquid storage container.

2. Related Background Art

Previously known liquid storage containers such as water bottles, etc. have such a structure that a cap is engaged with a pouring opening provided at the top of the container and a packing, etc. is provided at the sealing interface between the cap and the pouring opening. However, when the liquid contained in the container is in vigorous movement while the container is carried, the liquid may directly hit the cap and permeate into the packing at the sealing interface under the prevailing pressure, and ultimately a liquid leakage may take place at the cap.

An example of an apparatus provided with such a liquid storage container is an ink jet recording apparatus with a liquid ink, where a waste ink tank is provided as a kind of the liquid storage container for collecting the ink from the ink discharge nozzles in a recording head by suction or leakage. The waste ink tank generally has such a structure that a pouring opening is provided at the top of the container and a plug provided with a tube is tightly engaged with the pouring opening. However, the conventional liquid storage container such as the waste ink tank, etc. has the probelm that, while the liquid storage container is transported, irrespective of being provided in the apparatus or detached from the apparatus, the liquid contained in the container is put into vigorous movement to directly hit the tube connection at the top of the container, so that the liquid may flow back through the tube or may leak through the engaged joint, causing pollution of the apparatus and the surrounding environment.

To prevent such backflow or leakage, a check valve or an air vent has been provided on the liquid storage container or the tube, but the problems have not been completely solved in contrast to the additional parts and labor thus required.

SUMMARY OF THE INVENTION

An object of the present invention is to provide a liquid storage container freed from the problems of the prior art and having a simple structure capable of preventing the liquid from hitting the cap and also from leakage at the cap even if the liquid surface is placed in vigorous movement, and also to provide an apparatus provided with such a container.

Another object of the present invention is to provide a liquid storage container freed from the problems of the prior art and having a simple structure capable of effectively preventing the liquid from hitting the pouring opening and for preventing backflow or leakage, and also to provide an apparatus provided with such a container.

PREFERRED EMBODIMENTS OF THE INVENTION

The present invention will be described in detail below, with reference to the drawings.

Figure 1:
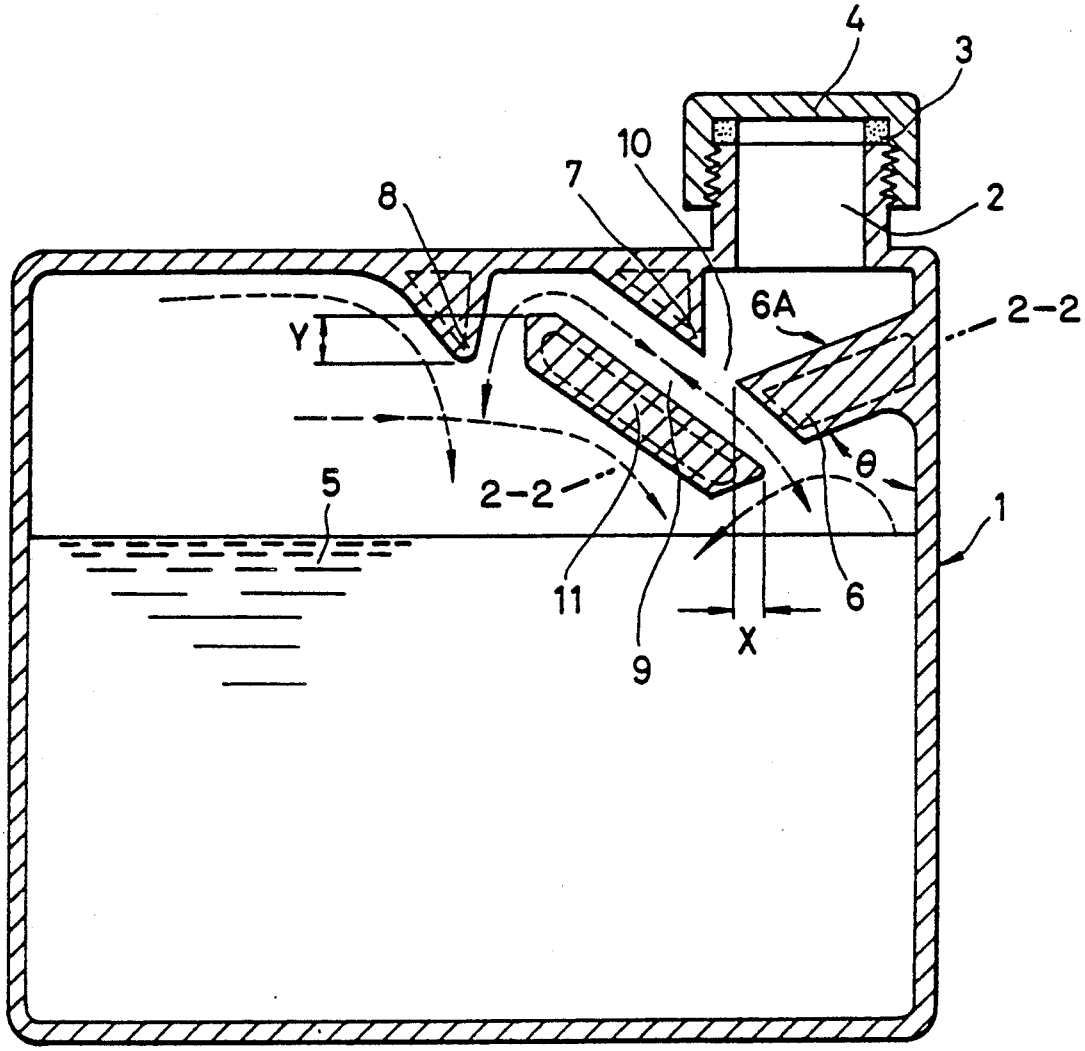
FIG. 1 is a vertical cross-sectional view taken along the center line of a liquid storage container according to one embodiment of the present invention.

According to one embodiment shown in FIG. 1, a pouring opening 2 is formed at the top of a vessel 1 made from plastic, etc. by molding, etc., and is tightly sealed with a cap 4 by securing the pouring opening 2 with the cap 4 through a packing 3 as a sealing member therebetween. A passage capable of preventing straight access of a liquid 5 to the pouring opening 2 secured with the cap 4 and making the liquid 5 on the way to the pouring opening 2 flow back downwardly is formed below and near the pouring opening 2 or the cap 4.

In the embodiment shown in FIG. 1, the passage capable of preventing the liquid splashing is formed by a projected weir member 6 extended to cover the down space below the pouring opening 2 and having a downwardly inclined surface 6A that can facilitate falling of the liquid to be charged from the pouring opening 2, two members 7 and 8 vertically and downwardly projected from the top wall of the vessel 1 and capable of preventing straight access of the liquid 5 to the space above the projected weir member 6, and a shield wall member 11 provided across from an opening 10 (formed by the member 7 and the projected weir member 6) to the pouring opening 2, thereby forming a channel 9 between the projected weir member 6, the member 7 and the shield wall member 11. The upper end of the shield wall member 11 is positioned between the members 7 and 8.

The liquid flow shown by dotted arrow lines in FIG. 1 develops by the presence of such a passage, and no such splashing of liquid 5 as to allow the liquid 5 to reach the pouring opening 2 can occur. Thus, the passage can prevent any splashing of liquid 5.

In this structure, the lower surface of the projected weir member 6 is downwardly inclined at an angle $\theta$, the projected weir member 6 and the lower end of the shield wall member 11 overlap each other for a predetermined distance X in the horizontal direction, and the member 8 and the upper end of the shield wall member 11 also overlap each other for a predetermined distance Y in the vertical direction, whereby straight access or direct invasion of the liquid 5 to the pouring opening 2 and the cap 4 can be effectively prevented.

Figure 2:
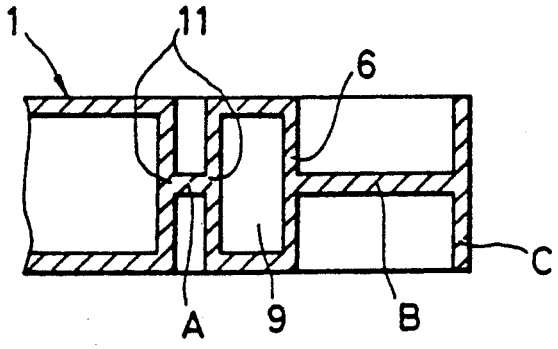
FIG. 2 is a cross-sectional view along the line II—II of FIG. 1.

The shield wall member 11, and the projected weir member 6, etc. which constitutes the passage, can be formed from an integrally molded wall member so as to traverse the vessel 1, as shown in FIG. 2, where ribs A, B and C are provided in the passage structure but may be omitted, if necessary.

In the embodiment described above, the liquid 5 can be prevented from straight invasion into the space below the pouring opening 2 or cap 4 of vessel 1, and also the liquid flowing on the way thereto can be made to immediately flow back downwardly by the passage. Thus, even if this liquid is put into vigorous movement to cause billowing or splashing while carrying or transporting the container, the liquid 5 can be prevented from flowing into or hitting the cap 4, and thus can be prevented from permeating the sealing member 3. That is, a liquid storage container without any liquid leakage can be obtained.

The passage can be molded together with the vessel, and thus a liquid storage container of simple structure without any liquid leakage can be obtained without any increase in the number of component parts.

An embodiment of using the liquid storage container as a waste ink tank in an ink jet recording apparatus will be described below.

Figure 3:
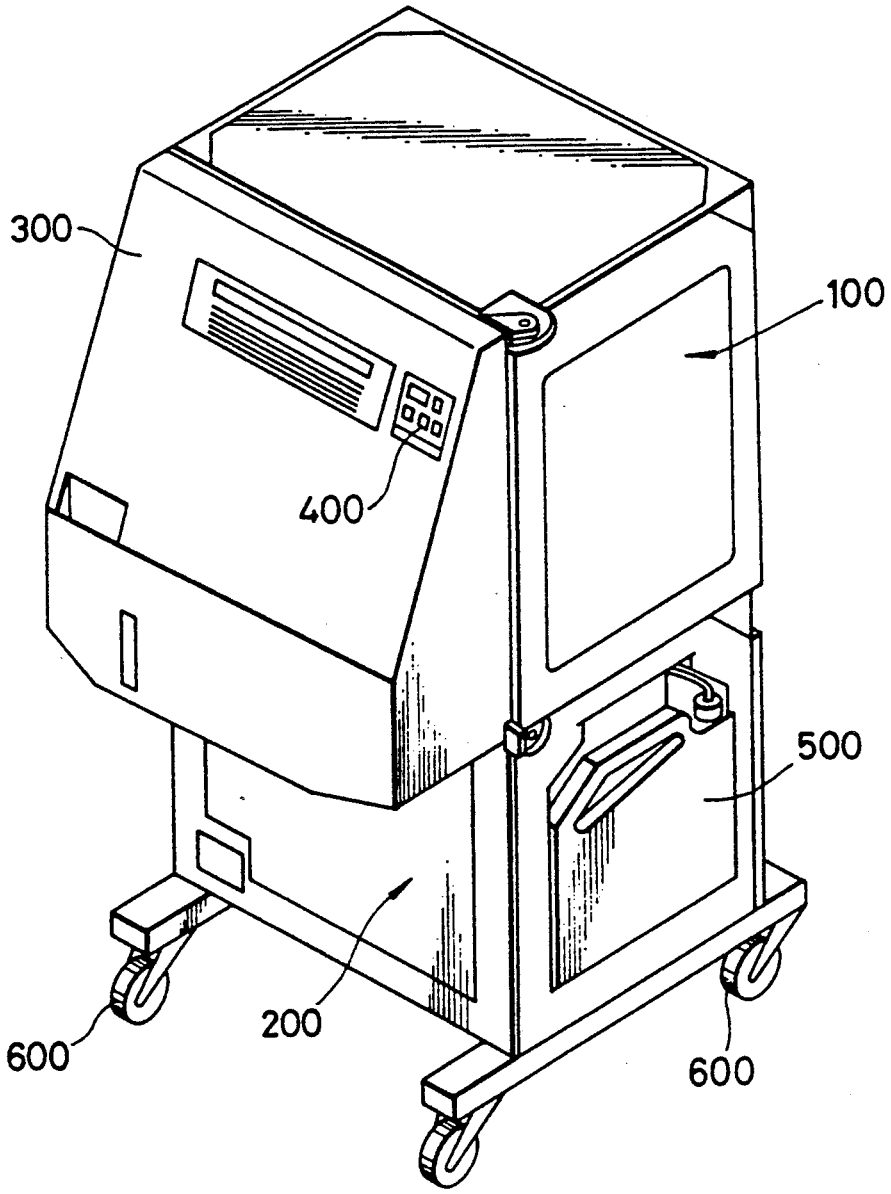
FIG. 3 is a perspective view of an ink jet recording apparatus with the present liquid storage container.

In FIG. 3, an ink jet recording apparatus comprises a recording unit 100, a controller unit 200, a paper supply unit 300, a display panel 400, and a drain tank (waste ink tank) 500 as the liquid storage container, and is provided with wheels (caster wheels) 600 at the four corners at the bottom.

The waste ink tank 500 is a container into which the ink discharged from the ink jet head through the ink discharge recovery operation of the recording unit 100 is collected through a waste ink tube and is stored, and is detachably mounted on the side of the apparatus as shown in FIG. 3. That is, the waste ink tank 500 is a liquid (waste ink) storage container in the ink jet recording apparatus.

Figure 4:
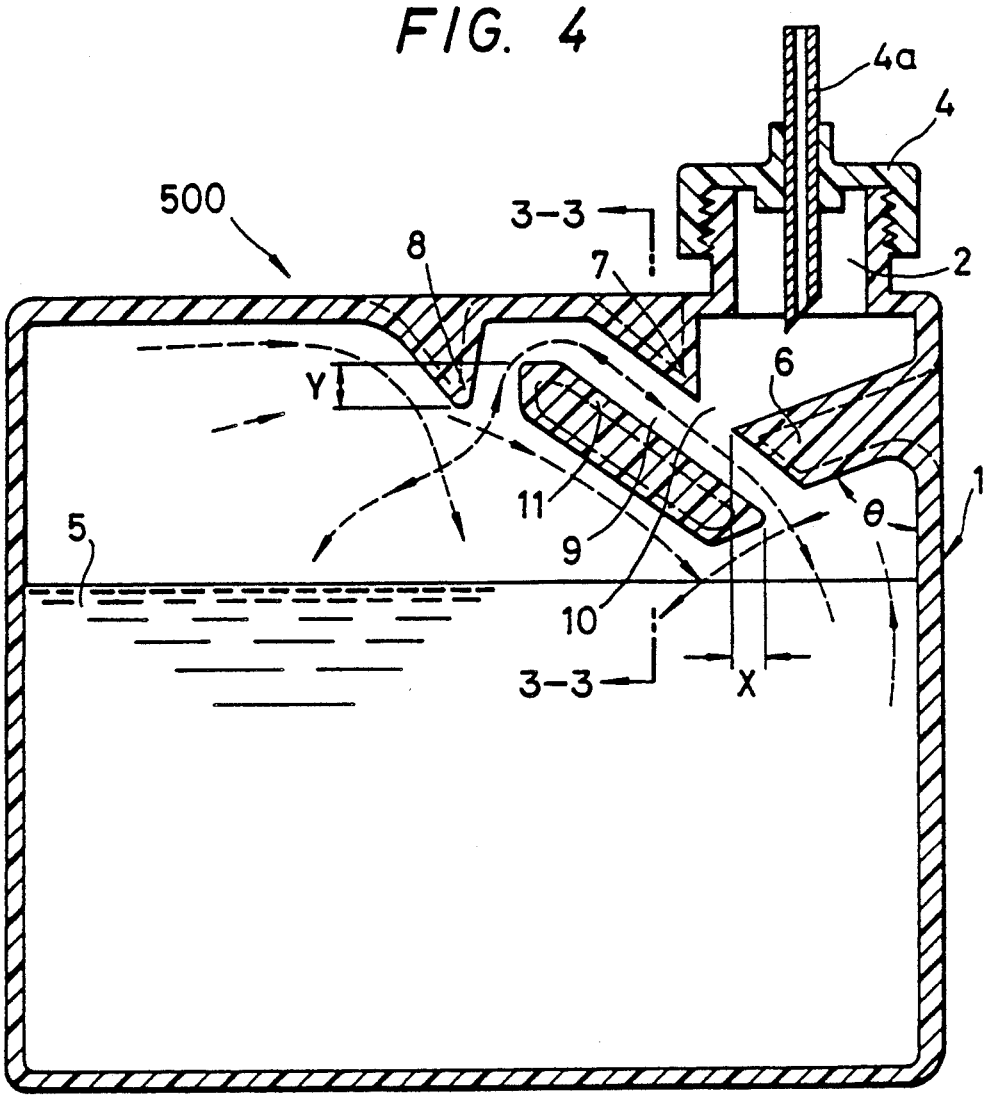
FIG. 4 is a vertical cross-sectional view taken along the center line of a liquid storage container according to another embodiment of the present invention.
Figure 5:
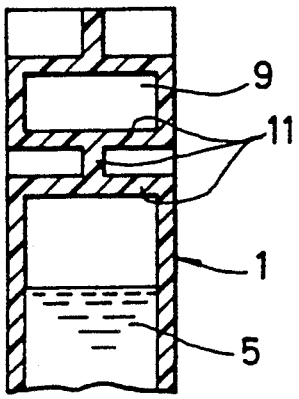
FIG. 5 is a cross-sectional view taken along the line III—III in FIG. 4

The liquid storage container shown in FIG. 4 and FIG. 5 shows another embodiment of the liquid storage container of FIG. 1 and FIG. 2 and is not always identical especially in the appearance, etc. with that of FIG. 3.

The liquid storage container 500 shown in FIG. 4 and FIG. 5 is not basically different from that shown in FIG. 1 and FIG. 2. The only difference is that the liquid storage container shown in FIG. 1 and FIG. 2 is destined to reserve and store a liquid, and thus the pouring opening 2 is closed with the cap 4, whereas in the liquid storage container shown in FIG. 4 a tube 4*a* is provided at the pouring opening (inlet) 2 through a tube 4*a*.

The liquid storage container 500 shown in FIG. 4 and FIG. 5 will be described in detail below:

According to the embodiment shown in FIG. 4, a pouring opening 2 is formed at the top of a vessel 1 made from plastic, etc. by molding, etc., and the end part of a tube 4*a* is inserted into the pouring opening 2 through a cap 4 and the tube 4 is tightly sealed through the hole provided through the cap 4.

A passage capable of preventing straight access of a liquid 5 to the pouring opening 2 secured with the cap 4 and making the liquid 5 flowing to the pouring opening 2 flow back downwardly is formed below and to the rear of the pouring opening 2.

Also provided are: a projected weir member 6 inclinedly extended to cover the down space below the pouring opening 2, two members 7 and 8 vertically and downwardly projected from the top wall of the vessel 1 and capable of preventing straight access of the liquid 5 to the space above the projected weir member 6, and a shield wall member 11 provided against an opening 10 (formed by the member 7 and the projected weir member 6) adjacent pouring opening 2 are formed, thereby forming a channel 9 between the projected weir member 6, the member 7 and the shield wall member 11. The upper end of the shield wall member 11 is positioned between the members 7 and 8. The liquid can be circulated as shown by dotted arrow lines in FIG. 4 by the presence of such a passage, while allowing no invasion of the liquid into the pouring opening 2.

In this structure, the lower surface of the projected weir member 6 is downwardly inclined at an angle $\theta$ and the projected weir member 6 and the lower end of the shield wall member 11 overlap each other for a predetermining distance X in the horizontal direction, and the member 8 and the upper end of the shield wall member 11 also overlap each other for a predetermined distance Y in the vertical direction, whereby straight access or direct invasion of the liquid 5 into the pouring opening 2 can be effectively prevented.

The passage can be formed by walls concave from both sides of the vessel 1 so as to traverse the vessel 1, as shown in FIG. 5.

In the embodiment described above, the liquid (ink) 5 can be prevented from straight access to the pouring opening 2 of the vessel 1 by providing the passage below and near the pouring inlet 2 of the vessel 1. Thus, even if the liquid is put into vigorous movement while carrying the liquid storage container containing a liquid alone or as mounted on the apparatus, the liquid can be prevented from invasion into or hitting the sealing member at the pouring opening 2 or the opening of the tube 4. That is, liquid leakage and backflow can be effectively prevented in the present invention. The passage can be molded together with the vessel, and thus a liquid storage container of simple structure without any liquid leakage or backflow can be obtained with any increase in the number of component parts.

Furthermore, even the liquid flowing to the pouring opening 2 can be made to flow back before reaching the pouring opening 2 by the presence of the flow back means facilitating flow back or downflow of a liquid such as the inclined passage 9, etc.

According to other embodiment shown in FIG. 6, a passage capable of preventing straight access of a liquid 5 to a pouring opening 2 and causing the liquid flowing to the pouring opening immediately flow back is provided below and near the pouring opening 2, and also a grip 12 provided at the top of vessel 1 is made to have a circulating channel 13 inside. That is, a hollow grip 12 is employed.

Figure 6:
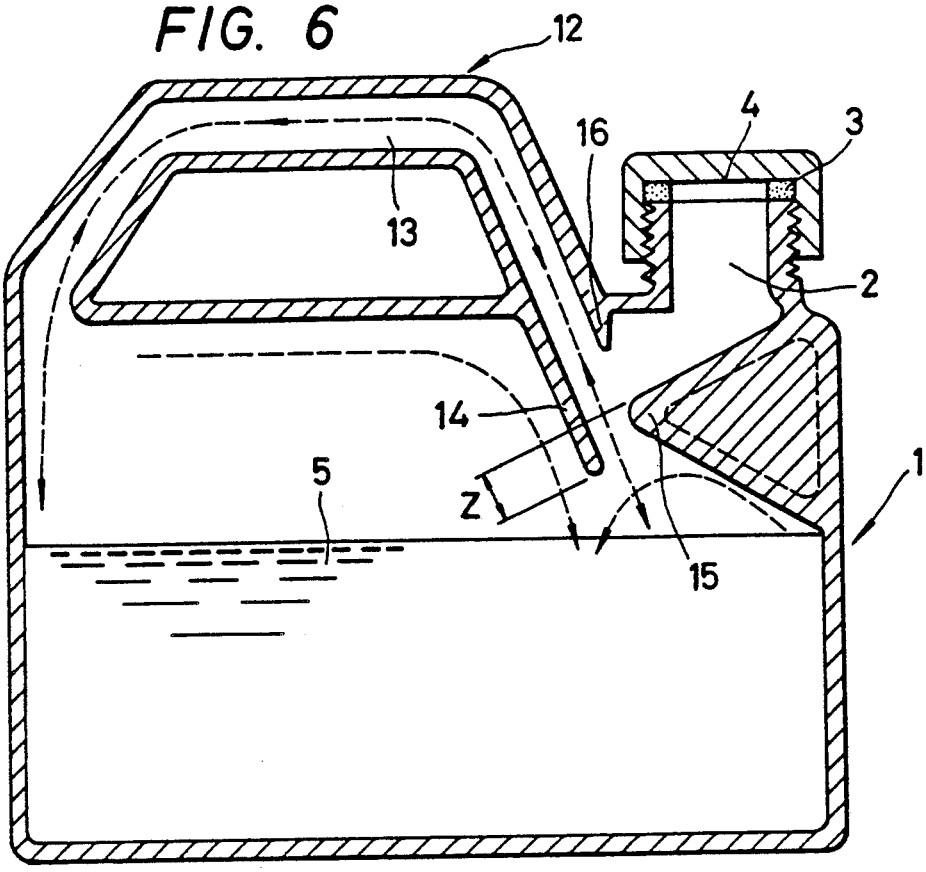
FIG. 6 is a cross-sectional view taken along the center line of a liquid storage container according to another embodiment of the present invention.

The grip 12 is connected to the vessel 1 at both ends as shown in FIG. 6, and the circulating channel 13 formed inside the grip 12 has a shield wall member 14 and a projection (vertically and downwardly extending member) 16 as extended from the opening of the channel on the side of pouring opening 2.

A projected weir member 15 extended to cover the pouring opening 2 is formed below the pouring opening 2.

The lower end of the shield wall member 14 overlaps the projected weir member 15 only for a predetermined distance Z, whereby the liquid invasion into the pouring opening, can be prevented even if the liquid 5 is put into vigorous movement, though the liquid flow as shown by the dotted arrow line develops. The liquid flowing near the pouring opening 2 can be made to immediately flow back along the inclined surface of the projected weir member 15. The shape and arrangement of the circulating channel 13 are so made as to prevent ready invasion of the liquid 5 through either opening of the channel 13 or invasion of the liquid 5 into the pouring opening 2, even if the liquid level is put in vigorous motion to cause billowing or splashing.

Thus, according to the embodiment of FIG. 6, the liquid leakage through the cap 4 can be effectively prevented as in the embodiment of FIG. 1, and also the passage structure provided below the pouring opening 2 can be simplified by the provision of the circulating channel 13 on the side of the pouring opening 2 as compared to that of FIG. 1.

Figure 7:
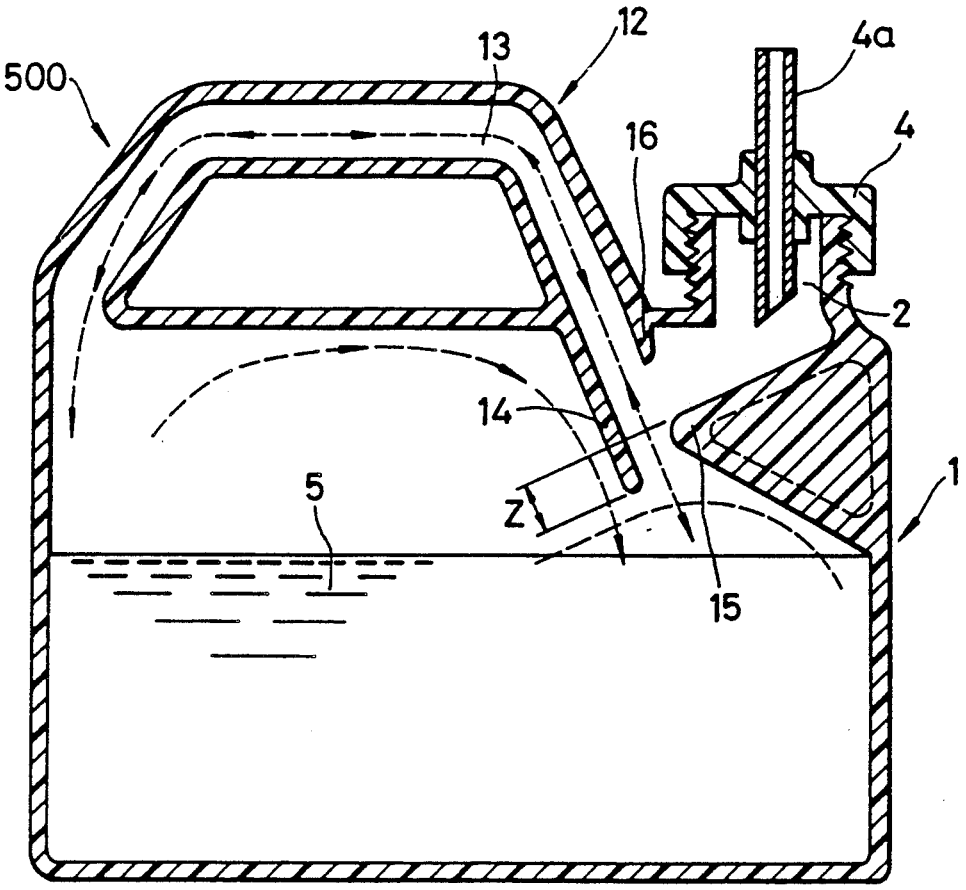
FIG. 7 is a cross-sectional view taken along the center line of a liquid storage container according to further embodiment of the present invention.

An example of using a liquid storage container of the similar structure to that of FIG. 6 as a waste ink tank is shown in FIG. 7. The only difference between the embodiment of FIG. 6 and that of FIG. 7 is that the cap 4 of FIG. 6 is a mere lid, whereas the cap 4 of FIG. 7 has a hole through which a tube 4*a* is provided.

According to the embodiment shown in FIG. 7, a passage capable of preventing straight access of a liquid 5 to a pouring opening 2 and facilitating downward backflow of the liquid is provided below and near the pouring opening 2, and furthermore a hollow grip 12 having a circulating passage 13 inside is formed to connect both ends of the grip 12 to the top of a vessel 1. A shield wall member 14 is formed to extend from the connection of the circulating passage 13 or the side of the pouring opening 2, and a projected weir member 15 is formed below the pouring opening 2 to cover it. The lower end of the shield wall member 14 overlaps the projected weir member 15 only for a predetermined distance Z, whereby the liquid is effectively prevented from reaching the pouring opening 2 when the liquid level 5 is put into vigorous movement, though the liquid flow shown by the dotted arrow line develops.

The liquid reaching the neighborhood pouring opening 2 is made to immediately downwardly flow back along the inclined surface of the projected weir member 15. Thus, in the embodiment of FIG. 7, substantially the same effect and function as in FIG. 6 can be obtained, and the liquid leakage or backflow can be prevented, and also the passage structure below the pouring opening 2 can be simplied by the formation of the circulating channel 13, as shown in FIG. 7.

According to a further embodiment shown in FIG. 8, a passage to be provided below and near the pouring opening 2 (or cap 4) at the top of a vessel 1, that is, a passage capable of preventing straight access of a liquid 5 to the pouring opening 2 and causing the liquid flowing to the pouring opening 2 immediately downwardly flow back, is composed of an inner cap 20 as a rubbery flexible and detachable member. The inner cap 20 is detachably engaged with an inner flange member 21 formed at the lower end of the pouring opening 2 in a lightly sealed state.

The inner cap 20 comprises a circulating channel 22 with both openings on the bottom side, and two openings 23 and 24 communicating with the space in the pouring opening 2. The two openings 23 and 24 are provided at such positions that the liquid 5 cannot flow directly in a straight line into the space in the pouring opening 2. The liquid once it flows into the circulating channel 22 or the space in the pouring opening 2 can be made to immediately downwardly flow back. That is, the liquid flowing into the space in the pouring opening 2 is immediately downwardly discharged through the opening 24.

Figure 8:
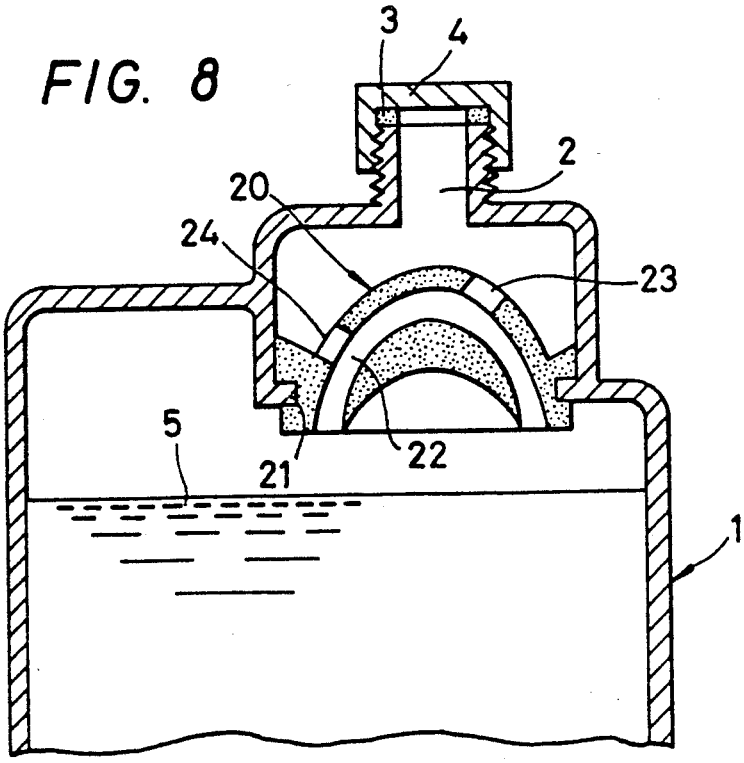
FIG. 8 is a cross-sectional view taken in part along the center line of a liquid storage container according to a further embodiment of the present invention.

In the embodiment of FIG. 8, the same effect of preventing a liquid leakage through the cap as in FIG. 6 can be obtained, and furthermore, only the passage member can be exchanged as desired because the passage member is composed of a detachable, rubbery inner cap 20, and thus the internal structure of a liquid storage container can have an improved accomodation.

In a still further embodiment shown in FIG. 9, the passage below the pouring opening 2 is formed by a projected weir member 26 large enough to cover most of the space below the pouring opening 2, a member 17 vertically projected from the end of the pouring opening 2 against the projected weir member 26, and a shield wall member 18 provided below the projected weir member 16 and the member 17 to form a channel between the projected weir member 26, the member 17 and the shield wall member 18.

Figure 9:
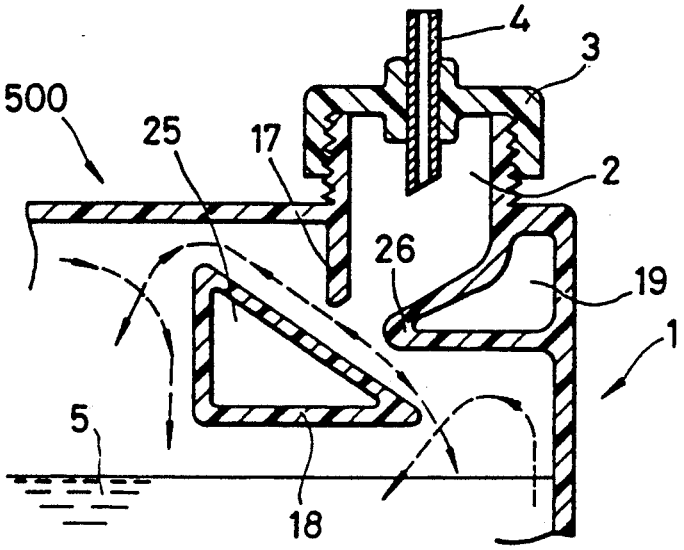
FIG. 9 is a cross-sectional view taken in part along the center line of a liquid storage container according to still another embodiment of the present invention.

In such a passage structure, any liquid flow reaching the pouring opening 2 can be prevented, when the liquid level 5 is put into vigorous movement, though a liquid flow shown by the dotted arrow lines in FIG. 9 develops. A liquid storage container without any liquid leakage and backflow during the transportation, etc. can be obtained as in the aforementioned embodiments.

In the embodiment of FIG. 9, the projected weir member 26 and the shield wall member 18 are formed around openings 19 and 25 through the vessel 1, different from the embodiments of FIG. 4 and FIG. 5.

As described above, the present liquid storage container can be widely used as vessels for preserving or for storing various beverages such as water, tea, juice, wine, alcohols, etc., or various industrial purpose liquids such as industrial water, liquid chemicals, oils, fuels, coolants, etc., or liquid wastes from various industries. As an apparatus using the present liquid storage container, the ink jet recording apparatus has been discussed, but the present liquid storage container can be used not only as a waste ink tank for the ink jet recording apparatus, but also as vessels for storing waste liquids from various apparatuses or for preserving liquids for various apparatuses.

What we claim is:

1. A liquid container comprising:

a supply port for supplying liquid; and liquid path forming means provided in said liquid container for preventing direct backflow of liquid in said container to said supply port, said liquid path forming means including:

a projecting member having a sloped surface provided below said supply port;

means for defining a first flow path for passing liquid therethrough, said means including a lowermost section of said sloped surface and defining a first port; and means for defining a second flow path for passing liquid into said container, said means including a portion of said projecting member and defining a second port, wherein the second port is in communication with a lowermost portion of the second flow path, and the first port is in communication with an intermediate portion of the second flow path.

2. A liquid container comprising:

(a) a supply port for supplying liquid;

(b) liquid path forming means provided in said liquid container for preventing direct backflow of liquid in said container to said supply port, said liquid path forming means including:

a projecting member having a sloped surface provided below said supply port;

means for defining a first flow path for passing liquid therethrough, said means including a lowermost section of said sloped surface and defining a first port; and means for defining a second flow path for passing liquid into said container, said means including a portion of said projecting member and defining a second port, wherein the second port is in communication with a lowermost portion of the second flow path, and the first port is in communication with an intermediate portion of the second flow path; and (c) an inner cap disposed proximate to said supply port, wherein said liquid path forming means is formed in said inner cap.

3. A liquid container comprising:

(a) a supply port for supplying liquid; and (b) liquid path forming means provided in said liquid container for preventing direct backflow of liquid in said container to said supply port, said liquid path forming means including:

a projecting member having a sloped surface provided below said supply port;

means for defining a first flow path for passing liquid therethrough, said means including a lowermost section of said sloped surface and defining a first port; and means for defining a second flow path for passing liquid into said container, said means including a portion of said projecting member and defining a second port, wherein the second port is in communication with a lowermost portion of the second flow path, and the first port is in communication with an intermediate portion of the second flow path; and (c) a hollow handle on an upper side of said container.

4. A liquid container comprising:

(a) a supply port for supplying liquid; and (b) liquid path forming means provided in said liquid container for preventing direct backflow of liquid in said container to said supply port, said liquid path forming means including:

a projecting member having a sloped surface provided below said supply port;

means for defining a first flow path for passing liquid therethrough, said means including a lowermost section of said sloped surface and defining a first port;

means for defining a second flow path for passing liquid into said container, said means including a portion of said projecting member and defining a second port, wherein the second port is in communication with a lowermost portion of the second flow path, and the first port is in communication with an intermediate portion of the second flow path; and a depending portion and a shielding wall portion, and wherein said depending portion and said projecting member define the first port, and wherein said shielding wall portion is disposed proximate to the first port and in the flow path of liquid flowing therethrough.

5. An ink jet recording apparatus comprising:

a recording unit having an ink jet recording head for discharging ink;

a paper supply unit; and a liquid storing container including;

a supply port for supplying liquid; and liquid path forming means provided in said liquid storing container for preventing direct backflow of liquid in said container to said supply port, said liquid path forming means including;

a projecting member having a sloped surface provided below said supply port;

means for defining a first flow path for passing liquid therethrough, said means including a lowermost section of said sloped surface and defining a first port; and means for defining a second flow path for passing liquid into said container, said means including a portion of said projecting member and defining a second port, wherein the second port is in communication with a lowermost portion of the second flow path, and the first port is in communication with an intermediate portion of the second flow path.

6. An ink jet recording apparatus according to claim 5, wherein said liquid storing container contains liquid to be supplied to said recording head.

7. An ink jet recording apparatus according to claim 5, wherein said liquid storing container contains liquid exhausted from said recording head.

8. An ink jet recording apparatus according to claim 5, wherein said liquid path forming means further comprises a depending portion and a shielding wall portion, and wherein said depending portion and said projecting member define the first port, and said shielding wall portion is disposed proximate to the first port and in the flow path of liquid flowing therethrough.

9. An ink jet recording apparatus according to claim 5, further comprising an inner cap disposed proximate to said supply port, wherein said liquid path forming means is formed in said inner cap.

10. An ink jet recording apparatus according to claim 5, wherein said liquid path forming means includes a hollow handle on an upper side of said container.

* * * * *

UNITED STATES PATENT AND TRADEMARK OFFICE

CERTIFICATE OF CORRECTION

PATENT NO. : 5,085,355

DATED : February 4, 1992

INVENTOR(S) : Shigeru Yoshimura, et al.

It is certified that error appears in the above-identified patent and that said Letters Patent is hereby corrected as shown below:

COLUMN 1:

Line 5, "4,848,602." should read --4,848,602, issued July 18, 1989.--.

COLUMN 5:

Line 49, "neighborhood" should read --neighborhood of the--.

Signed and Sealed this

Seventh Day of September, 1993

Bruce Lehman

*Attest:*

BRUCE LEHMAN

*Attesting Officer*

*Commissioner of Patents and Trademarks*